United States Patent [19]

Green et al.

[11] 4,045,328

[45] Aug. 30, 1977

[54] PRODUCTION OF HYDROGENATED COAL LIQUIDS

[75] Inventors: Robert C. Green, Berkeley Heights; Robert L. Dubell, Florham Park, both of N.J.

[73] Assignee: Exxon Research and Engineering Company, Linden, N.J.

[21] Appl. No.: 707,963

[22] Filed: July 23, 1976

[51] Int. Cl.[2] ..... C10G 1/06

[52] U.S. Cl. ..... 208/8

[58] Field of Search ..... 208/8

[56] References Cited

U.S. PATENT DOCUMENTS

| | | | |
|---|---|---|---|
| 3,505,203 | 4/1970 | Nelson | 208/8 |
| 3,645,885 | 2/1972 | Harris et al. | 208/8 |
| 3,700,583 | 10/1972 | Salamony et al. | 208/8 |
| 3,726,784 | 4/1973 | Correa et al. | 208/8 |
| 3,726,785 | 4/1973 | Keller et al. | 208/8 |

*Primary Examiner*—Delbert E. Gantz
*Assistant Examiner*—James W. Hellwege
*Attorney, Agent, or Firm*—James E. Reed

[57] ABSTRACT

In a coal liquefaction process wherein feed coal is contacted with molecular hydrogen and hydrogen-donor solvent in a liquefaction zone to form coal liquids and vapors and coal liquids in the solvent boiling range are thereafter hydrogenated to produce recycle solvent and liquid products, the improvement which comprises separating the effluent from the liquefaction zone into a hot vapor stream and a liquid stream, combining a portion of the hot vapor stream with makeup hydrogen and with coal liquids in the solvent boiling range, passing the combined vapor, hydrogen and coal liquids to the solvent hydrogenation zone as feed to the hydrogenation zone, discharging the remainder of the vapor stream as purge after cooling to recover vaporized hydrocarbons and removing contaminants, and thereafter catalytically hydrogenating the hydrogenation zone feed stream while quenching the hydrogenation reaction with fluids recovered from the hydrogenation zone effluent.

10 Claims, 2 Drawing Figures

PRODUCTION OF HYDROGENATED COAL LIQUIDS

BACKGROUND OF THE INVENTION

1. Field of the Invention

This invention relates to coal liquefaction and is particularly concerned with integrated liquefaction processes in which coal liquids produced by the treatment of feed coal with molecular hydrogen and a hydrogen-donor solvent are subsequently hydrogenated for the production of recycle solvent and additional liquid products.

2. Description of the Prior Art

Among the more promising processes for the production of liquid hydrocarbons from coal are those in which the feed coal is first contacted with molecular hydrogen and a hydrogen-donor solvent in a liquefaction zone at elevated temperature and pressure and a portion of the liquid product is then catalytically hydrogenated in a solvent hydrogenation zone to generate solvent for recycle to the liquefaction step and produce additional liquid products. Hydrogenation of the liquid in the solvent boiling range is generally carried out at a pressure similar to or somewhat lower than that employed in the liquefaction zone and at a somewhat lower temperature. To supply the heat required to raise the solvent boiling range liquid to the hydrogenation temperature, it has been proposed that all of the vaporous product taken overhead from the liquefaction zone be passed directly to the solvent hydrogenation zone without cooling and that the quantity of coal liquids are recycle hydrogen which is mixed with the vaporous product and fed to the hydrogenation zone be adjusted so that the combined feed stream is maintained at the required hydrogenation temperature. This eliminates the need for a furnace to preheat the feed stream. Because the hydrogenation reaction is exothermic, additional cold feed is introduced into the hydrogenation zone downstream of the initial inlet point to quench the reaction and at the same time heat this additional feed to the necessary hydrogenation temperature.

Although the process described above has advantages over earlier processes from the standpoint of conserving thermal energy, it pores certain operational problems which tend at least in part to offset the heat conservation advantages. The use of the liquefaction vapors to provide all of the heat needed to raise the initial increment of the liquid feed to the hydrogenation temperature and thus eliminate the need for a furnace limits the ratio in which liquid and vapor can be introduced into the initial stage of the hydrogenation zone and imposes restrictions with respect to the hydrogen partial pressure in the initial stage. In addition, the cold feed introduced downstream of the initial stage has a relatively short residence time within the hydrogenation zone and hence uniform hydrogenation to achieve maximum solvent and product yields may be difficult to obtain. Overhydrogenation may sometimes occur. Moreover, the introduction of relatively cold feed into the reaction zone at one or more points downstream of the feed and hydrogen more difficult to achieve, may promote product degradation and the production of excessive quantities of gas and low molecular weight hydrocarbons, and makes the overall reaction difficult to control. As a result of these and related disadvantages, the overall efficiency of such a process may leave much to be desired.

SUMMARY OF THE INVENTION

This invention provides an improved process for the preparation of liquid products from coal or similar liquefiable carbonaceous solids which at least in part alleviates the difficulties referred to above and has advantages over liquefaction processes proposed in the past. In accordance with the invention, it has now been found that hydrogenated liquid products can be produced from bituminous coal, subbituminous coal, lignite and similar feed materials by first treating the coal or other solid feed material at elevated temperature and pressure with molecular hydrogen and a hydrogen-donor solvent in a noncatalytic liquefaction zone, separating the overhead effluent from the liquefaction zone into a hot vapor stream and a liquid stream, combining a portion of the hot vapor with makeup hydrogen and liquid in the solvent boiling range, passing the combined vapor, hydrogen and liquid to the solvent hydrogenation zone, and discharging the remainder of the vapor stream as purge after the recovery of vaporized hydrocarbons and the removal of contaminants such as ammonia, hydrogen chloride, hydrogen sulfide, and carbon dioxide.

The liquid stream recovered from the liquefaction zone effluent is fractionated to produce a gaseous fraction, a distillate fraction including constituents within the donor solvent boiling range, and a bottoms fraction boiling in excess of about 1000° F. The heavy 1000° F.+ bottoms product recovered from the liquefaction zone effluent is passed to a coking zone or the like for upgrading into more valuable products. The distillate fraction is preheated by indirect heat exchange with the effluent from the solvent hydrogenation zone and then mixed with the hot vapor stream and makeup hydrogen. The mixed solvent hydrogenation feed stream thus prepared may be passed through a preheat furnace and heated to the hydrogenation reaction temperature if desired. Only a relatively small increase in temperature is generally needed at this point and in most cases the preheat furnace can be dispensed with.

The hot mixed feed is introduced into the solvent hydrogenation zone, preferably a multistage reactor provided with means for introducing a quench between stages, and hydrogenation takes place. The effluent from the hydrogenation zone is passed in indirect heat exchange with the distillate containing solvent boiling range constituents and then separated, preferably at substantially hydrogenation pressure, into a vapor fraction composed primarily of hydrogen and normally gaseous hydrocarbons and a liquid fraction. The vapor fraction is treated for the removal of acid gases and the like and may be in part recycled to the hydrogenation zone, preferably between stages, for use as a gaseous quench. The remaining vapor is recycled for introduction into the coal-solvent slurry fed to the liquefaction zone. The liquid stream recovered from the hydrogenation zone effluent is fractionated to produce overhead gases and naphtha and a heavier liquid fraction which may be in part recycled to the hydrogenation zone for introduction between stages as a liquid quench. The remainder of this heavier fraction is recycled to the slurry preparation zone or withdrawn as product.

If a gaseous quench is used in the solvent hydrogenation zone, the liquid stream recovered from the hydrogenation zone effluent can be passed directly to a stripper for the removal of light ends. No preheat furnace or sidestream strippers need be provided unless two or more different sidestream and bottoms products are desired. If a liquid quench is used, on the other hand, a preheat furnace and fractionating tower provided with sidestream strippers will be employed, the bottoms from the tower being used for quench purposes and the sidestreams serving as a source of recycle solvent.

The process of this invention makes efficient use of the heat in both the effluent from the liquefaction zone and that from the solvent hydrogenation zone, eliminates the necessity for multiple high pressure purge streams, permits purging at a lower rate than might otherwise be required, reduces the amount of makeup hydrogen needed, alleviates difficulties that may otherwise be encountered as a result of the nonuniform hydrogenation of coal liquids produced in the liquefaction zone, reduces the likelihood of hydrocracking and other undesired reactions in the hydrogenation zone, simplifies control of the process, results in greater process flexibility, is less expensive than earlier processes, and has other advantages over liquefaction processes proposed in the past.

DESCRIPTION OF THE PREFERRED EMBODIMENTS

Figure 1:
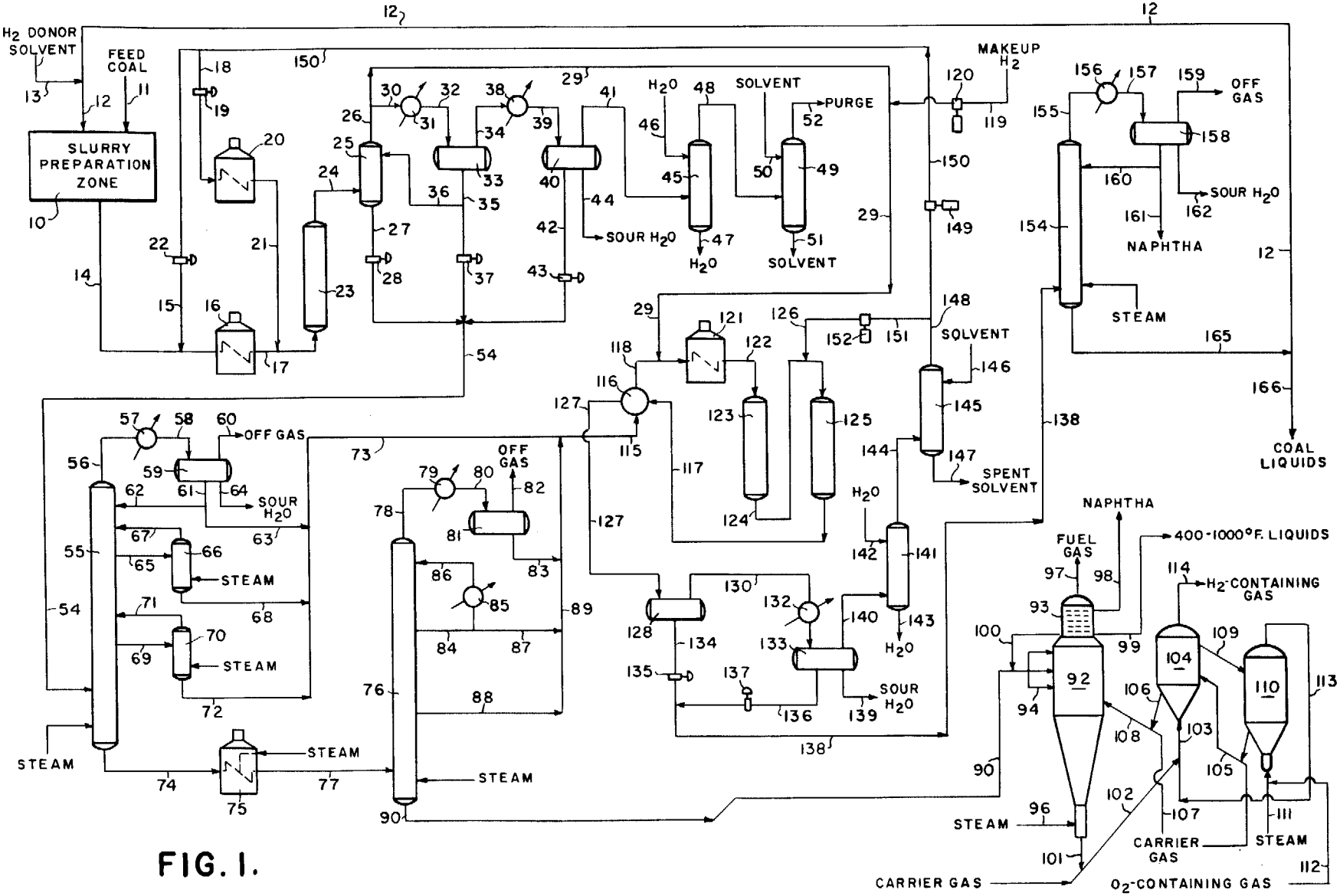
FIG. 1 in the drawing is a schematic flow diagram of a process carried out in accordance with the invention for the production of hydrogenated liquid products from coal with a gaseous quench; and, FIG. 2 is a schematic diagram of an alternate embodiment of the process in which a liquid quench is employed.

The process depicted in FIG. 1 of the drawing includes a slurry preparation zone 10 into which feed coal is introduced through line 11 from a coal storage or feed preparation zone not shown in the drawing and combined with a preheated hydrogen-donor solvent introduced through line 12 to form a slurry. The coal employed will normally consist of solid particles of bituminous coal, subbituminous coal, lignite or a mixture of two or more such materials having a particle size on the order of about one-fourth inch or larger along the major dimension. It is generally preferred to crush and screen the feed coal to a particle size of about 8 mesh or smaller on the U.S. Sieve Series scale and to dry the feed coal particles to remove excess water, either by conventional techniques before the solids are mixed with the solvent in the slurry preparation zone or by mixing the wet solids with hot solvent at a temperature above the boiling point of water, preferably between about 250° F. and about 350° F., to vaporize any excess water present. The moisture in the feed slurry will preferably be reduced to less than about 2 weight percent. The hydrogen-donor solvent required for initial startup of the process and any makeup solvent that may be needed can be added to the system through line 13. The process of the invention normally produces an excess of liquid hydrocarbons in the donor solvent boiling range and hence the addition of makeup solvent is generally unnecessary. Solvent will therefore normally be fed through line 13 for startup purposes only.

The hydrogen-donor solvent used in preparing the coal-solvent slurry will normally be a coal-derived solvent, preferably a hydrogenated recycle solvent containing at least 20 weight percent of compounds which are recognized as hydrogen donors at the elevated temperatures of from about 700° to about 900° F. which are generally employed in coal liquefaction operations. Solvents containing at least 50 weight percent of such compounds are preferred. Representative compounds of this type include indane, $C_{10}$–$C_{12}$ tetrahydronaphthalenes, $C_{12}$ and $C_{13}$ acenaphthenes, di-, tetra-, and octahydroanthracenes, tetrahydroacenaphthenes, crysene, phenanthrene, pyrene and other derivatives of partially saturated aromatic compounds. Such solvents have been described in the literature and will be familiar to those skilled in the art. The solvent composition resulting from the hydrogenation of a recycle fraction will depend in part upon the particular coal used as the feedstock to the process, the process steps and operating conditions employed for liquefaction of the coal, the particular boiling range fraction selected for hydrogenation, and the hydrogenation conditions employed within the hydrogenation zone. In the slurry preparation zone 10, the incoming feed coal is normally mixed with solvent recycled through line 12 in a solvent-to-coal ratio of from about 0.8:1 to about 2:1. Ratios of from about 1:1 to about 1.7:1 are generally preferred.

The coal-solvent slurry prepared as described above is withdrawn from slurry preparation zone 10 through line 14 and introduced, together with vapor recycled through line 15, into mixed phase preheat furnace 16 where the feed materials are heated to a temperature within the range between about 750° F. and about 950° F. The mixture of hot slurry and vapor withdrawn from the furnace through line 17 will contain from about 1 to about 8 weight percent, preferably from about 2 to about 5 weight percent, of molecular hydrogen on a moisture and ash-free basis. In lieu of mixing the slurry and recycle vapor or treat gas prior to preheating as described above, the vapor can be passed through line 18 containing valve 19, separately preheated in furnace 20, and thereafter passed through line 21 for admixture with the hot slurry in line 17. If this procedure is used, valve 22 in line 15 will normally be closed and valve 19 will be opened. This use of separate preheat furnaces has certain advantages and is often preferred. Where two furnaces are provided, a part of the recycle vapor or treat gas can be preheated in each of the furnaces if desired.

The mixture of hot slurry and recycle vapor from line 17 is fed into liquefaction reactor 23 which is maintained at a temperature between about 750° F. and about 950° F., preferably between about 825° F. and about 875° F., and at a pressure between about 1000 psig and about 3000 psig, preferably between about 1500 and about 2500 psig. Although a single upflow liquefaction reactor is shown in the drawing, a plurality of reactors arranged in parallel or series can be employed if desired. The liquid residence time within reactor 23 will normally range between about 5 minutes and about 100 minutes and will preferably be from about 10 to about 60 minutes. Within the liquefaction zone, high molecular weight constituents of the coal are broken down and hydrogenated to form lower molecular weight gaseous, vapor and liquid products. The hydrogen-donor solvent contributes hydrogen atoms which react with organic radicals liberated from the coal and prevent their recombination. The hydrogen in the recycle vapor stream injected with the slurry serves as replacement hydrogen for depleted hydrogen-donor molecules in the solvent and results in the formation of additional hydrogen-donor molecules by in situ hydrogenation. Process conditions within the liquefaction zone are selected to insure the generation of sufficient hydrogen-donor precursors and at the same time provide sufficient liquid product for proper operation of the solvent hydrogenation zone. These conditions may be varied as necessary.

The effluent from liquefaction zone 23 is taken overhead through line 24. This effluent stream will normally include gaseous liquefaction products such as carbon monoide, carbon dioxide, ammonia, hydrogen, hydrogen chloride, hydrogen sulfide, methane, ethane, ethylene, propane, propylene, naphtha, and the like; unreacted hydrogen from the feed slurry; solvent boiling range hydrocarbons; and heavier liquefaction products including solid liquefaction residues. This stream is passed to reactor effluent separator 25 where it is separated at substantially liquefaction reactor pressure and at a temperature only slightly lower than that in the liquefaction reactor into a hot overhead vapor stream having a temperature of from about 700° to 900° F. which is withdrawn through line 26 and a liquid stream taken off through line 27 containing pressure letdown valve 28. A portion of the hot vapor stream in line 26 is passed without further cooling through line 29 for mixing with makeup hydrogen and solvent boiling range hydrocarbons as described hereafter. The remaining vapor passes from line 26 into line 30. The relative quantities of hot vapor sent through line 29 to the solvent hydrogenation unit and that passed into line 30 will depend in part upon the particular operating conditions employed in the system, the composition of the vapor stream, and other factors but in general it is preferred to pass from about 50 to about 80% of the vapor by volume through line 29 to the solvent hydrogenation stage of the process. The sending of about 60 to 70% of the vapor stream to solvent hydrogenation is particularly advantgeous.

The vapor stream passed through line 30 enters heat exchanger 31 where it is cooled to a temperature between about 400° and about 700° F., preferably between about 500° and about 600° F., and then passes through line 32 into hot liquefaction separator 33, still at substantially liquefaction pressure. Gases and vapors are taken off overhead from the hot separtor through line 34 and liquids are withdrawn through line 35. A portion of the liquid stream may be returned through line 36 to reactor effluent separator 25 for use as wash oil. The remaining liquid is then dicharged through pressure letdown valve 37. The gases and vapors in line 34 pass through heat exchanger 38 where they are further cooled, preferably to substantially atmospheric temperature, without any substantial reduction in pressure. From the heat exchanger, the gases and vapors flow through line 39 into cold liquefaction separator 40 where a further separation takes place. An overhead stream containing hydrogen, carbon monoxide, carbon dioxide, ammonia, hydrogen chloride, hydrogen sulfide, normally gaseous hydrocarbons, and some naphtha boiling range hydrocarbons is withdrawn through line 41. A liquid stream containing dissolved gases but composed primarily of liquid hydrocarbons boiling below about 700° F. at atmospheric pressure is recovered through line 42 containing pressure letdown value 43. A sour water stream produced by the condensation of water vapor is withdrawn from separator 40 through line 44.

The gases and vapors recovered from the cold liquefaction separator are passed from line 41 into liquefaction water scrubber 45 where they are contacted with water introduced through line 46 for the removal of ammonia, hydrogen chloride, and other water-soluble constituents. Water containing the dissolved contaminants is withdrawn from the scrubber through line 47 and passed to cleanup facilities not shown in the drawing. The scrubbed gas and vapor is then passed through line 48 into solvent scrubber 49 where it is contacted with monoethanolamine, diethanolamine or a similar solvent introduced through line 50 for the removal of hydrogen sulfide, carbon dioxide and other acid gases. Spent solvent is withdrawn from this scrubber through line 51 and sent to a solvent recovery unit which does not appear in the drawing for removal of the adsorbed materials and regeneration of the solvent. The scrubber gases are taken overhead through line 52 and purged from the system. This gas stream will be composed primarily of hydrogen and light hydrocarbon gases but will generally also contain small amounts of normally liquid hydrocarbons. Hydrogen in the stream can be separated, cryogenically, for example, for reuse in the process or can be employed as a fuel or use for other purposes.

By regulating the amount of vapor sent to the solvent hydrogenation portion of the process and the amount passed through the gas scrubbing unit for purging, all of the purge required for the integrated system can be handled at this one point and the necessity for additional high pressure purge lines at other locations to prevent the buildup of carbon monoxide and light hydrocarbon gases can be avoided. The concentration of hydrogen in this purge stream will normally be somewhat lower than that in the purge from earlier processes and hence, for a given pressure, the process can be operated with a lower purge rate and less makeup hydrogen than would otherwise be required. If the purged gas is to be used for the generation of makeup hydrogen, by cryogenics or stream reforming for example, the compression facilities and hydrogen generating equipment can be smaller than would otherwise be needed. If the purged gas is to be used for fuel, less hydrogen will be consumed than would be the case with a gas of higher hydrogen content. Since the hydrogen generating facilities may account for as much as 25% of the total cost of a commercial coal liquefaction plant, this lower hydrogen content of the purge gas constitutes a significant advantage for the process of the invention.

The liquid stream withdrawn from liquefaction reactor effluent separator 25 through line 27 and the liquids recovered from hot liquefaction separator 33 and cold liquefaction separator 40 through lines 35 and 42 are combined following reduction of the pressure to about 100 psia or less and passed through line 54 to atmospheric fractionation unit 55. Here the feed is fractionated and an overhead fraction composed primarily of gases and naphtha constituents boiling up to about 400° F. is withdrawn through line 56. This overhead fraction is cooled in exchanger 57 and passed through line 58 to fractionator distillate drum 59 where the gases are taken off overhead through line 60. These gases may be employed as a fuel gas for the generation of process heat or used for other purposes. The liquid hydrocarbons separated from the gas are withdrawn through line 61 and a portion of this stream may be returned through line 62 to the upper part of the fractionating column. The remaining liquid may be passed through line 63 for use as feed to the solvent hydrogenation unit or taken off as a naphtha product boiling below the solvent boiling range. A sour water stream is withdrawn from the distillate drum through line 64 and passed to water cleanup facilities not shown. One or more intermediate fractions boiling within the range between about 250° F. and about 700° F. are withdrawn from the atmospheric fractionator for use as feed to the solvent hydrogenation reactor. It is generally preferred to recover a relatively light fraction composed primarily of constituents boiling below about 500° F. by means of line 65, stripper 66, vapor return line 67 and line 68 and to recover a heavier intermediate fraction composed primarily of constituents boiling below about 700° F. by means of line 69, stripper 70, vapor return line 71 and line 72. These two intermediate distillate fractions plus naphtha recovered from the overhead stream are passed through line 73 for use as liquid feed to the solvent hydrogenation unit. A portion of one or both of these streams can also be withdrawn as product through a withdrawal line not shown in the drawing if desired. The bottoms fraction from the atmospheric column, composed primarily of constituents boiling in excess of about 700° F. and including unreacted solids and residues, is withdrawn through line 74, is normally heated to a temperature of about 600° to 775° F. in furnace 75, and is introduced into vacuum fractionation unit 76 through line 77. In some cases, the furnace can be omitted.

In the vacuum fractionation column, the feed is distilled under reduced pressure to permit the recovery of an overhead fraction which is withdrawn through line 78, cooled in heat exchanger 79, and then passed through line 80 into distillate drum 81. Gases and vapors which may be employed as fuel ae taken off through line 82, pass to the vacuum equipment, and then may be employed as fuel. Liquids are withdrawn through line 83. A heavier intermediate fraction, one composed primarily of constituents boiling below about 850° F., for example, may be recovered by means of line 87 friom a pumparound circuit conisting of line 84 heat exchanger 85, line 86, and line 87. A still heavier side stream may be withdrawn through line 88, which may also include a pumparound. These three distillate fractions are passed through line 89 and combined with the distillate in line 73 for use as feed to the solvent hydrogenation unit. A part of one or all of these streams may also be taken off as product through a withdrawal line not shown in the drawing if desired. A bottoms fraction boiling in excess of about 1000° F. at atmospheric pressure and containing unreacted coal solids and residues is withdrawn from the vacuum fractionation column through line 90 and may be used for the production of additional liquid products and hydrogen as described hereafter or upgraded in other ways.

There are a number of alternates to the fractionation step described above which may be employed if desired. One such alternate, for example, is to pass the liquid stream from the reactor effluent separator and liquefaction separator to a centrifuge, gravity settling unit, filter or the like for the removal of unreacted coal solids from the liquids prior to fractionation. Antisolvents such as hexane, decalin, or certain petroleum hydrocarbon liquids can be added to the liquefaction products to facilitate separation of the unreacted coal and ash residues from the liquids and permit their removal from the system. Processes of this type have been described in the literature and will be familiar to those skilled in the art. The liquids remaining following the solids separation step can then be separated by fractionation into a naphtha fraction, one or more intermediate streams to be fed to the solvent hydrogenation reactor, and if desired a heavier fraction which can be upgraded by hydrocracking and other downstream processing techniques.

Another alternate procedure which may in some cases be advantageous is to pass the liquid stream from the reactor effluent separator and liquefaction separators through a line not shown in the drawing to a coking unit associated with the process for upgrading of the liquid by thermal cracking and other reactions. The coking unit will normally include a coker fractionation tower in which the vaporized product from the coker is distilled to produce an overhead gas stream, a naphtha stream, one or more intermediate fractions useful as feed to the solvent hydrogenation stage of the process, and a heavier bottoms fraction which can be recycled for the production of additional liquids and coke. The coking unit will produce coke which can be subsequently gasified to produce hydrogen or employed for other purposes. Still other modifications in the initial handling of the liquid product from the liquefaction reaction which may be employed to produce solvent hydrogenation reactor feed and other products suitable for upgrading will suggest themselves to those skilled in the art.

The coking unit shown in the drawing is an integrated system including a fluidized bed coker, a heater and an associated gasified. In this system, the hot liquefaction bottoms from the vacuum fractionator are passed through line 90 into fluidized bed coking unit 92. This unit will normally be provided with an upper scrubbing and fractionation section 93 from which liquid and gaseous products produced as a result of the coking reactions can be withdrawn. The unit will generally also include one or more internal cyclone separators or similar devices not shown in the drawing which serve to remove entrained particles from the upflowing gases and vapors entering the scrubbing and fractionations section and return them to the fluidized bed below. A plurality of feed lines 94 will ordinarily be provided as shown to obtain better distribution of the feed material within the coking zone. This zone contains a bed of fluidized coke particles which are maintained in the fluidized state by means of steam or other fluidizing gas introduced near the bottom of the unit through line 96. The fluidized bed is normally maintained at a temperature between about 1000° F. and about 1500° F. by means of hot char which is introduced into the upper part of the reaction section of the coker through line 108. The pressure within the reaction zone will generally range between about 10 and about 30 pounds per square inch gauge but higher pressures can be employed if desired. The optimum conditions in the reaction zone will depend in part upon the characteristics of the particular feed material employed and can be readily determined.

The hot liquefaction bottoms fed into the fluidized bed of the coking unit is sprayed onto the surfaces of the coke particles in the bed. Here the material is rapidly heated to bed temperatures. As the temperature increases, lower boiling constituents are vaporized and the heavier portions undergo thermal cracking and other reactions to form lighter products and additional coke on the surfaces of the bed particles. Vaporized products, steam, and entrained solids move upwardly through the fluidized bed and enter the cyclone seprators or other devices where solids present in the fluids are rejected. The fluids then move into the scrubbbing and fractionation section of the unit where refluxing takes place. An overhead gas stream is withdrawn from the coker through line 97 and may be employed as a fuel or the like. A naphtha side stream is withdrawn through line 98 and may be combined with naphtha produced at other stages in the process. A heavier liquids fraction having a nominal boiling range between about 400° F. and about 1000° F. is withdrawn as a side stream through line 99 and may be combined with coal liquids produced elsewhere in the process. Heavy liquids boiling above about 1000° F. may be recycled through line 100 to the incoming feed stream.

The coke particles in the fluidized bed in the reaction section of the coker tend to increase in size as additional coke is deposited. These particles gradually move downwardly through the fluidized bed and are eventually discharged from the reaction section through line 101 as a dense phase solids stream. This stream is picked up by steam or other carrier gas and transported upwardly through line 102 and line 103 into fluidized bed heater 104. Here the coke particles are heated to a temperature of from about 50° to about 300° F. above that in the reaction section of the coker by means of hot gases introduced through line 103. Hot solids are withdrawn from the bed of heater 104 through standpipe 106, picked up by steam or other carrier gas introduced through line 107, and returned to the reaction section of the coker through line 108. The circulation rate between the coker and heater is thus maintained sufficiently high to provide the heat necessary to keep the coker at the required temperature. If desired, additional heat can be provided by the introduction of air or oxygen into the heater through a line not shown in the drawing.

Hot carbonaceous particles are continuously circulated from the fluidized bed in heater 104 through line 109 to fluidized bed gasifier 110. Here the particles are contacted with steam introduced into the lower end of rthe gasifier through line 11 and with oxygen injected through line 112. The oxygen reacts with carbon in the solids to produce carbon oxides and generate heat. The steam reacts with carbonaceous solids to produce a gas containing hydrogen, carbon monoxide, carbon dioxide and some methane. If desired, an alkali metal catalyst or an alkaline earth metal catalyst may be employed to catalyze the gasification reaction. The gas produced is taken overhead from the gasifier through line 113 and passed through line 103 to the heater 104 where heat is recovered and employed to raise the temperature of coke particles circulated from the coking unit through line 102 and from the gasifier through line 105. A hydrogen-rich gas is withdrawn overhead through line 114 and sent to downstream processing equipment where the gas may be shifted over a water-gas shift catalyst to increase the ratio of hydrogen to carbon monoxide, acid gases may be removed, and residual carbon monoxide may be catalytically methanated to produce a high purity hydrogen stream suitable for use as makeup hydrogen in the associated liquefaction and solvent hydrogenation steps of the process. Conventional shift, acid gas removal, and methanation procedures can be employed. The solids circulation rate between the heater and gasifier will normally be adjusted to maintain the gasifier temperature within the range between about 1200° and 1800° F. The use of an alkali metal or alkaline earth metal gasification cataltst permits gasification at temperatures below those which would be required in the absence of a catalyst and thus facilitates use of the heater to provide the heat needed for both the coking unit and the gasifier. It is generally preferred to employ such a catalyst and to operate the coking unit and gasifier at a temperature between about 1200° and about 1500° F. and to operate the fluidized bed heater at a temperature of about 1500° to about 1800° F. In lieu of such an operation employing oxygen for the production of a hydrogen-containing gas, air can be injected through line 112 and the resulting nitrogen-containing gas withdrawn through line 114 can be used as a fuel.

As pointed out above, the feed to the solvent hydrogenation stage of the process includes liquid hydrocarbons composed primarily of constituents in the 250° to 700° F. boiling range recovered from atmospheric fractionator 55 and heavier hydrocarbons in the nominal 700° to 1000° F. range recovered from vacuum fractionator 76. It may also include hydrocarbons of similar boiling range characteristics recovered from associated coking unit 92. The hydrocarbon feed is passed through lines 73 and 89 into line 115 and heat exchanger 116. Here the feed material passes in indirect heat exchange with hot hydrogenated product withdrawn from the solvent hydrogenation reactor through line 117. The feed is preheated from an initial temperature of from about 100° to 500° F. to a final temperature of from about 600° to 750° F. at a pressure from about 800 to 300 psig. The preheated feed is withdrawn from the exchanger through line 118 and combined with hot vapor withdrawn from the liquefaction reactor effluent separator 25 through line 29. This vapor stream will include makeup hydrogen introduced into the system through line 119 and compressor 120. A heat exchanger not shown in the drawing will normally be used to heat the makeup hydrogen by indirect heat exchange with the vapor in line 130 or a similar stream. Depending upon the amiunt of makeup hydrogen added, the hydrogen temperature, and other factors, the vapor stream containing the hydrogen may have a temperature on the order of from about 700° to about 900° F. The vapor stream temperature will normally be somewhat higher than that of the liquid stream in line 118 and hence addition of the vaor will further heat the liquid feed. The combined stream may then be passed through solvent hydrogenation reactor preheat furnace 121 and further heated to a temperature up to about 750° F. if desired. The amount of heat which is added in the furnace is normally relatively small and hence, depending upon the ratio in which the hot vapor and liquid feed are mixed and the temperatures of the two streams, in most cases the furnace can be omitted or bypassed. The combined feed stream heated to the solvent hydrogenation temperature is withdrawn from the furnace through line 122 and fed to the hydrogenation unit.

The solvent hydrogenation reactor shown in the drawing is a two-stage downflow unit including an initial state 123 connected by line 124 to a second stage 125 but other type reactors can be used if desired. It is normally preferred to operate the solvent hydrogenation reactor at a pressure somewhat lower than that in liquefaction reactor 23 and at a somewhat lower temperature than that in the liquefaction reactor. The temperture, pressure, and space velocity employed will depend to some extent upon the character of the feed stream employed, the hydrogenation catalyst selected for the process, and other factors. In general, temperatures within the rage between about 550° F. and about 850° F., pressures between about 800 psig and about 3000 psig, and space velocities between about 0.3 and about 3 pounds of feed/hour/pound of catalyst are suitable. The makeup hydrogen rate should be sufficient to maintain the average reactor hydrogen partial pressure between about 500 and about 2000 psia. It is generally preferred to maintain a mean hydrogenation temperature within the reactor between about 675° F. and about 750° F., a pressure between about 1500 and about 2500 psig, a liquid hourly space velocity between about 1 and about 2.5 pounds of feed/hour/pound of catalyst, and a makeup hydrogen rate sufficient to maintain an average reactor hydrogen partial pressure within the range between about 900 and about 1600 psia.

Any of a variety of conventional hydrotreating catalysts may be employed in the process. Such catalysts typically comprise an alumina or silica-alumina support carrying one or more iron group metals and one or more metals from Group VI-B of the Periodic Table in the form of an oxide or sulfide. Combinations of one or more Group VI-B metal oxides or sulfides with one or more Group VIII metal oxides or sulfides are generally preferred. Representative metal combinations which may be employed in such catalyst include oxides and sulfides of cobalt-molybdenum, nickel-molybdenum-tungsten, cobalt-nickel-molybdenum, nickel-molybdenum, and the like. A suitable catalyst, for example, is a high metal content sulfided cobalt-molybdenum-alumina catalyst containing 1 to 10 weight percent of cobalt oxide and from about 5 to 40 weight percent of molbdenum oxide, preferably from 2 to 5 weight percent of the cobalt oxide and from 10 to 30 weight percent of the molybdenum oxide. Other metal oxides and sulfides in addition to those specifically referred to above, particularly the oxides or iron, nickel, chromium, tungsten and the like, can also be used. The preparation of such catalysts has been described in the literature and is welll known in the art. Generally, the actove metals are added to the relatively inert carrier by impregnation from aqueous solution and this is followed by drying and calcining to activate the catalyst. Carriers which may be employed include activated alumina, activated alumina-silica, zorconia, titania, bauxite, bentonite, montmorillonite, and mixtures of these and other materials. Numerous commercial hydrogenation catalysts are available from various catalyst manufacturers and can be used.

The hydrogenation reaction taking place within hydrogenation reactors 123 and 125 is an exothermic reaction in which substantial quantities of heat are liberated. The temperature in the reactor is controlled in the system of FIG. 1 to avoid overheating and runaway reaction or undue shortening of the catalyst life by controlling the feed temperature and by means of a gaseous quench stream introduced between the two stages by means of line 126. The quantity of quench injected into the system will depend in part upon the maximum temperature to which the catalyst is to be subjected, characteristics of the feed to the reactor, the temperature of the quench stream, and other factors. In general, it is preferred to monitor the reaction temperature at various levels within each stage of the reactor by means of thermocouples or the like and regulate the amount of feed and quench admitted so that the temperature does not exceed a predetermined maximum for that particular level. By increasing the amount of feed through line 122 and the amount of quench admitted through line 126 whenever the temperature within the reactor becomes too high, the overall reaction temperature can be maintained predetermined bounds. If the hydrogenation reaction is to be carried out in the lower part of the 555° F. to 850° F. range, as may be the case when coal liquids of relatively low specific gravity and low sulfur and nitrogen content are being hydrogenated, a somewhat greater increase in temperature may be permissible than will be the case where the hydrogenation reaction is to be carried out in the upper part of the range. Operations of the latter type are frequently used for the hydrogenation of liquid products having relatively high sulfur and nitrogen contents and high specific gravities. The optimum temperature and other conditions for a particularly feedstock and catalyst system can be readily determined.

The hydrogenated effluent produced in the solvent hydrogenation unit is withdrawn from the second stage 125 of the unit through line 117 at a temperature of from about 550° to about 850° F., preferably from about 700° to about 800° F., passed through heat exchanger 116 where it is cooled to a temperature on the order of from about 500° to about 700° F., and then passed through line 127 into solvent hydrogenation hot separator 128. An overhead gas stream is withdrawn from said separator at a temperature of from about 600° to about 700° F. through line 130 and thereafter cooled to substantially room temperature in heat exchanger 132. The cooled gas is then introduced into solvent hydrogenation cold separator 133 where hydrocarbon liquids and sour water are removed. The two separators will normally be operated at pressures between about 1500 and about 2000 psig. The liquids separated from the hydrogenated effluent in hot solvent hydrogenation separatpr 128 are withdrawn through line 134 containing pressure reduction valve 135 and combined with residual liquid hydrocarbons withdrawn from the solvent hydrogenation cold separator 133 through line 136 containing pressure reduction valve 137. The combined liquid stream is then passed through line 138 to a solvent stripping unit. Sour water from the solvent hydrogenation cold separator is withdrawn through line 139 for water treatment.

The gas stream recovered from the solvent hydrogenation cold separator is taken overhead through line 140. This gas stream will consist primarily of hydrogen and normally gaseous hydrocarbons but will also contain some naphtha boiling range constituents, traces of higher hydrocarbons, and contaminants such as carbon monoxide, carbon dioxide, ammonia, hydrogen sulfide and hydrogen chloride. The recovered gas passes from line 140 into water scrubber 141 where it is contacted with water introduced through line 142 for the removal of ammonia, hydrogen chloride and other water soluble constituents. Water containing the material removed from the gas is withdrawn through line 143 and sent to water cleanup facilities not shown. The scrubbed gas, still containing carbon dioxide and hydrogen sulfide, is taken overhead through line 144 to solvent scrubber 145. Here the gas is contacted with monoethanolamine, diethanolamine or a similar solvent introduced through line 146 for the removal of acid gases. Spent solvent is taken off through line 147 and sent to a solvent recovery unit which will normally include facilities for the recovery of sulfur. The scrubbed gas, now composed primarily of hydrogen and normally gaseous hydrocarbons with some carbon monoxide and a very small amounts of naptha boiling range hydrocarbons, passes through line 148 and flows in part to recycle gas compressor 149 where it is compressed to a pressure sufficient to permit its recycle to the liquefaction stage of the operation. Pressures on the order of from about 2000 psig to 3000 psig will normally be used. The compressed gas flows through line 150 and is injected into the coal-solvent feed stream, either through line 15 containing valve 22 or line 18 containing valve 19, or both. The remaining gas from line 148 is passed through line 151, raised back to the solvent hydrogenation zone pressure in compressor 152, and then injected through line 126 as gaseous quench. As pointed out earlier, the optimum amount of quench gas for a particular operation can be readily determined.

The liquids recovered from the solvent hydrogenation hot and cold separators, after reduction in the pressure to about 100 to 500 psig by means of pressure letdown valves 135 and 137, are passed through line 138 to solvent stripping unit 154. Here the liquids are stripped to remove gases and naphtha boiling range materials. The overhead vapor stream is taken off through line 155, cooled in heat exchanger 156 and introduced through line 157 into distillate drum 158. The off gases withdrawn through line 159 will be composed primarily of hydrogen and normally gaseous hydrocarbons but will include some normally liquid constituents in the naphtha boiling range. This steam can be used as a fuel or employed for other purposes. The liquid stream from drum 158, composed primarily of naphtha boiling range materials, is in part returned to the stripper through line 160 and in part recovered as naphtha product through line 161. A stream of sour water is also withdrawn from the distillate drum through line 162 and sent to water cleanup facilities.

One or more sidestreams boiling above the naphtha boiling range can be recovered from the liquids recovered from solvent hydrogenation if desired. If this is to be done, a preheat furnace not depicted in FIG. 1 will be used to heat the liquids from the hot and cold separators to a temperature of from about 650° F. to about 800° F. and a fractionating tower equipped with suitable sidestream strippers, not shown, will be employed in lieu of the solvent stripping unit 154. Normally, however, liquids boiling above the naphtha boiling range will be recovered from the solvent stripping unit as a bottoms fraction withdrawn through line 165. A portion of this steam is recycled through line 12 to the slurry preparation zone 10 for use in preparing the coal-solvent slurry fed to the liquefaction stage of the process. The remainder of the liquids stream, assuming that the net liquefaction products have not been withdrawn from the system earlier as product from fractionators 55 and 76, can be withdrawn as coal liquids product through line 166.

Figure 2:
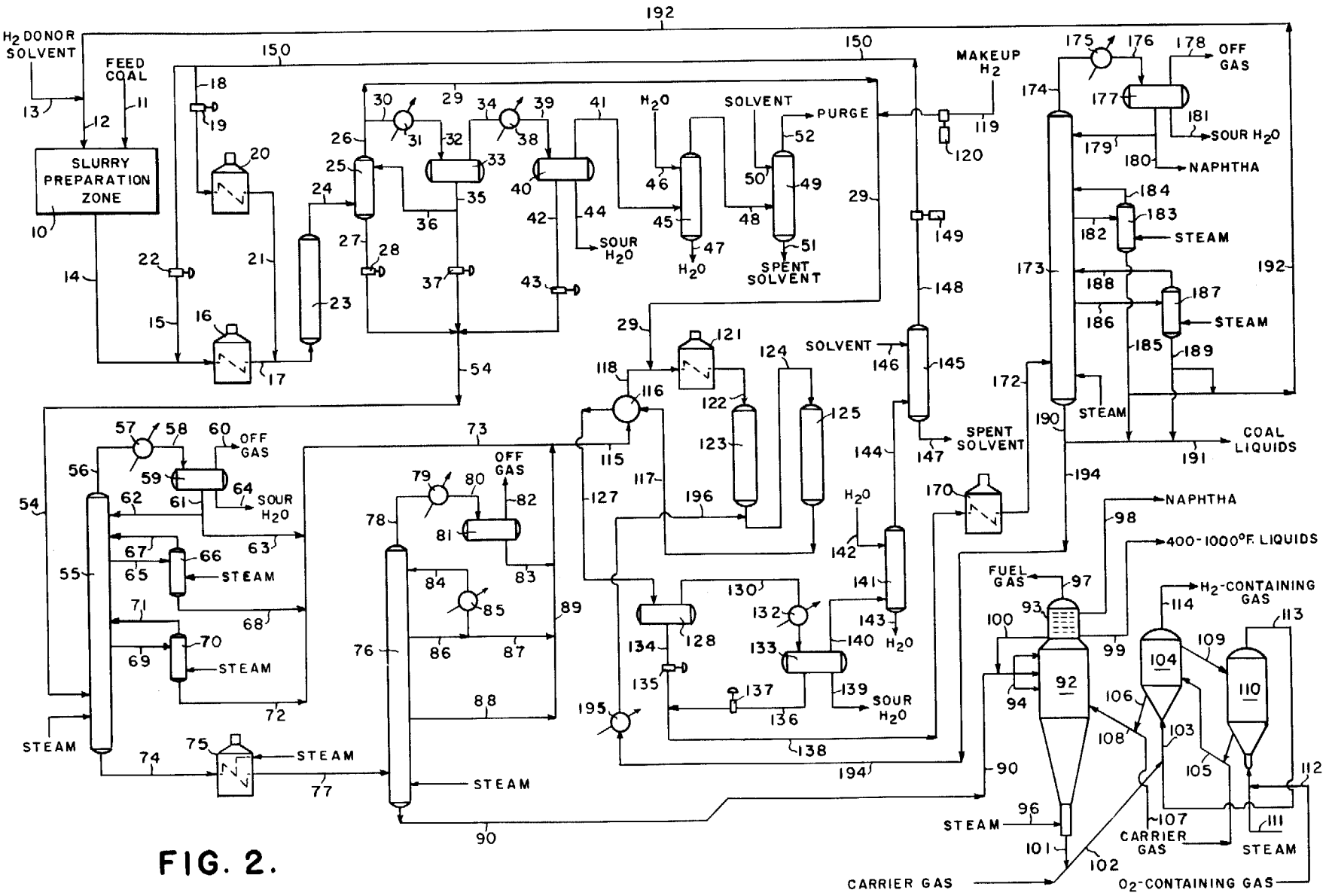

As pointed out earlier, the process of the invention can be operated with a liquid quench in lieu of a gas quench as described above. FIG. 2 in the drawing illustrates such a system. In this system, the liquefaction unit, the atmospheric and vacuum fractionating units, the solvent hydrogenation unit, and the bottoms coking unit can be essentially identical to those employed in the earlier system and need not be described in detail again. The principal difference in the two systems is in the treatment of the liquids withdrawn from the solvent hydrogenation hot and cold separators to produce the liquid quench and the injection of the quench stream. After reduction in pressure to about 400 to 500 psig by means of pressure letdown valves 135 and 137, the liquids recovered from the solvent hydrogenation hot and cold separators 128 and 133 are combined and passed through line 138 to final fractionator preheat furnace 170. Here the liquids are heated from a temperature a little below the solvent hydrogenation hot separator temperature to a higher temperature, normally between about 700° and about 750° F., and then passed through line 172 into final fractionator 173. The feed to the fractionator will contain hydrogen, normally gaseous hydrocarbons, liquid hydrocarbons boiling up to about 1000° F., and small amounts of acid gas constituents and other contaminants. This feed stream is fractionated to produce an overhead light ends product composed primarily of gases and naphtha boiling range hydrocarbons. The overhead vapor is taken off through line 174, cooled in heat exchanger 175 and introduced through line 176 into distillate drum 177. The off gases withdrawn through line 178 will be composed primarily of hydrogen and normally gaseous hydrocarbons but will include some normally liquid constituents in the naphtha boiling range. This stream can be used as a fuel or employed for other purposes. Thge liquid stream from drum 177, composed primarily of naphtha boiling range materials, is in part returned to the fractionator through line 179 and in part recovered as naphtha product through the line 180. A stream of sour water is also withdrawn from the distillate drum through line 181 and sent to water cleanup facilities.

One or more sidestreams boiling above the naphtha range and composed of intermediate boiling range hydrocarbons are recovered from fractionator 173. In the particularly installation shown in the drawings, a first sidestream composed primarily of hydrocarbons boiling up to about 700° F. is taken off through line 182 into stripper 183, the overhead vapor is returned through line 184, and the bottoms fraction is withdrawn through line 185. A second sidestream composed primarily of hydrocarbons boiling below about 850° F. is withdrawn from the fractionator through line 186 into stripper 187, the overhead vapor is returned through line 188, and the bottoms fraction is withdrawn through line 189. A bottoms stream composed primarily of hydrocarbons boiling below about 1000° F. is withdrawn from the fractionator through line 190. These three streams may in part be combined as shown and, if the net liquefaction product has not been withdrawn from the system as product from fractionators 55 and 56, withdrawn through line 191 as coal liquids product. A portion of the two sidestreams is recycled through line 192 to the slurry preparation zone 10 for use in preparing the coal-solvent slurry fed to the liquefaction stage of the process.

It will be noted that in this embodiment of the process all of the vapor stream in line 148 is recycled through line 150 after being raised to the liquefaction pressure by means of compressor 149. No gaseous quench is used. Instead, a portion of the bottoms steam withdrawn from fractionator 173 through line 190 is passed through line 194, cooled from the fractionator bottoms temperature of about 650° to about 750° F. down to a temperature between about 350° and about 450° F. in heat exchanger 195, and then passed through line 196 into line 123 between the two stages of the solvent hydrogenation unit. This use of a portion of the fractionator bottoms as a liquid quench is particularly advantageous because it aids in avoiding over-hydrogenation. The bottoms stream is in a sense segregated from the recycle solvent and in addition is sufficiently hot that it can readily be cooled to the optimum quenching temperature so that problems which might largely otherwise be encountered by quenching with cold feed can largely be avoided.

If desired, a mixture of bottoms and sidestreams from the final fractionator 173 can also be employed as a liquid quench for the solvent hydrogenation zone. The use of such a mixture is normally somewhat less effective than the use of bottoms alone as illustrated in FIG. 2 of the drawing but nevertheless has numerous advantages over systems which have been proposed in the past.

We claim:

1. A process for the production of liquid hydrocarbons from coal or similar liquefiable carbonaceous solids which comprises contacting said carbonaceous solids with a hydrogen-donor solvent and molecular hydrogen under liquefaction conditions in a liquefaction zone to produce a liquefaction effluent; separating said liquefaction effluent into a hot vapor stream and a liquid stream; recovering coal liquids in the hydrogen-donor solvent boiling range from said liquid stream; combining a portion of said hot vapor stream with makeup hydrogen and withsaid coal liquids to form a solvent hydrogenation feed stream; treating the remainder of said hot vapor stream for the removal of liquid hydrocarbons and contaminants and thereafter discharging the remaining gas as purge; passing said solvent hydrogenation feed stream to a catalytic solvent hydrogenation zone maintained under solvent hydrogenation conditions; recovering a hydrogenated effluent from said solvent hydrogenation zone; separating said hydrogenated effluent into a vaporous fraction containing molecular hydrogen and a liquids fraction; recycling at least a portion of said vaporous fraction including molecular hydrogen and at least a portion of said liquidsfraction to said liquefaction zone; and recycling fluid separated from said hydrogenated effluent to said solvent hydrogenation zone as a quench.

2. A process as defined by claim 1 wherein from about 50 to about 80 volume percent of said hot vapor steam is combined with said coal liquids and said makeup hydrogen.

3. A process as defined by claim 1 wherein said hot vapor stream is separated from said liquefaction effluent at a temperature of from about 700° to about 900° F.

4. A process as defined by claim 1 wherein liquid hydrocarbons removed from said remainder of said hot vapor stream are combined with said liquid stream.

5. A process as defined by claim 1 wherein said fluid recycled to said solvent hydrogenation zone as a quench is a gas.

6. A process as defined by claim 1 wherein said vaporous fraction is treated for the removal of contaminants, a portion of the treated gas is recycled to said solvent hydrogenation zone as quench, and the remainder of said treated gas is recycled to said liquefaction zone.

7. A process as defined by claim 1 wherein said liquids fraction separated from said hydrogenated effluent is stripped for the removal of gases and naphtha, a portion of the remaining liquids is recycled to said liquefaction zone, and the rest of said remaining liquids is withdrawn as product.

8. A process as defined by claim 1 wherein said fluid recycled to said solvent hydrogenation zone as a quench is a liquid.

9. A process as defined by claim 1 wherein said vaporous fraction is treated for the removal of contaminants and the treated gas is recycled in its entirety to said liquefaction zone.

10. A process as defined by claim 1 wherein said liquids fractions separated from said hydrogenated effluent is fractioned to produce light ends, intermediate boiling range hydrocarbons, and a bottoms fraction; said intermediate boiling range hydrocarbons are in part recycled to said liquefaction zone and in part withdrawn as product; and said bottoms fraction is at least in part recycled to said solvent hydrogenation zone as said quench.

* * * * *